US010434682B2

(12) United States Patent
Bonomi

(10) Patent No.: US 10,434,682 B2
(45) Date of Patent: Oct. 8, 2019

(54) QUICK CHAIN TENSIONING SYSTEM

(71) Applicant: Raffaele A. Bonomi, Wood Dale, IL (US)

(72) Inventor: Raffaele A. Bonomi, Wood Dale, IL (US)

( * ) Notice: Subject to any disclaimer, the term of this patent is extended or adjusted under 35 U.S.C. 154(b) by 0 days.

(21) Appl. No.: 15/816,038

(22) Filed: Nov. 17, 2017

(65) Prior Publication Data

US 2018/0141238 A1 May 24, 2018

Related U.S. Application Data

(60) Provisional application No. 62/497,518, filed on Nov. 22, 2016.

(51) Int. Cl.

| | |
|---|---|
| ***B28D 7/00*** | (2006.01) |
| ***B27B 17/14*** | (2006.01) |
| ***B28D 1/08*** | (2006.01) |

(52) U.S. Cl.

CPC ..... *B28D 7/00* (2013.01); *B27B 17/14* (2013.01); *B28D 1/082* (2013.01)

(58) Field of Classification Search

CPC ..... B28D 7/00; B28D 1/082; B27B 17/14

USPC ..... 30/386, 381, 382

See application file for complete search history.

(56) References Cited

U.S. PATENT DOCUMENTS

| | | | | |
|---|---|---|---|---|
| 5,078,119 A * | 1/1992 | Holmes | B23Q 9/0014 | 125/13.01 |
| 8,495,819 B2 * | 7/2013 | Okouchi | B27B 17/14 | 30/386 |
| 2014/0106915 A1 * | 4/2014 | Kistler | B27B 17/14 | 474/111 |

* cited by examiner

*Primary Examiner* — Omar Flores Sanchez

(74) *Attorney, Agent, or Firm* — Reinhart Boerner Van Deuren P.C.

(57) ABSTRACT

A quick tensioning system applicable to handheld chainsaws is provided wherein, during chain re-tensioning, the chain guiding bar remains firmly anchored to the bar holder and guiding means are provided to retract the motorized driving sprocket versus said guiding bar. The system includes a guide interposed between a stationary bar holding body and a motor body. This allows a linear or a rotation relative movement between the sliding driving sprocket and the stationary guiding bar. A drive is provided by means of a screw that an operator can easily operate via a knob conveniently mounted nearby the chainsaw handle.

11 Claims, 7 Drawing Sheets

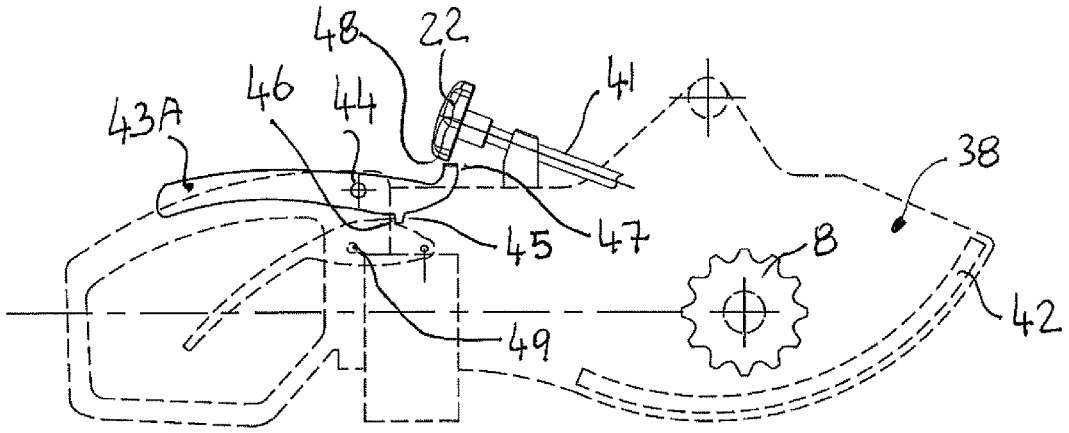
Fig 8
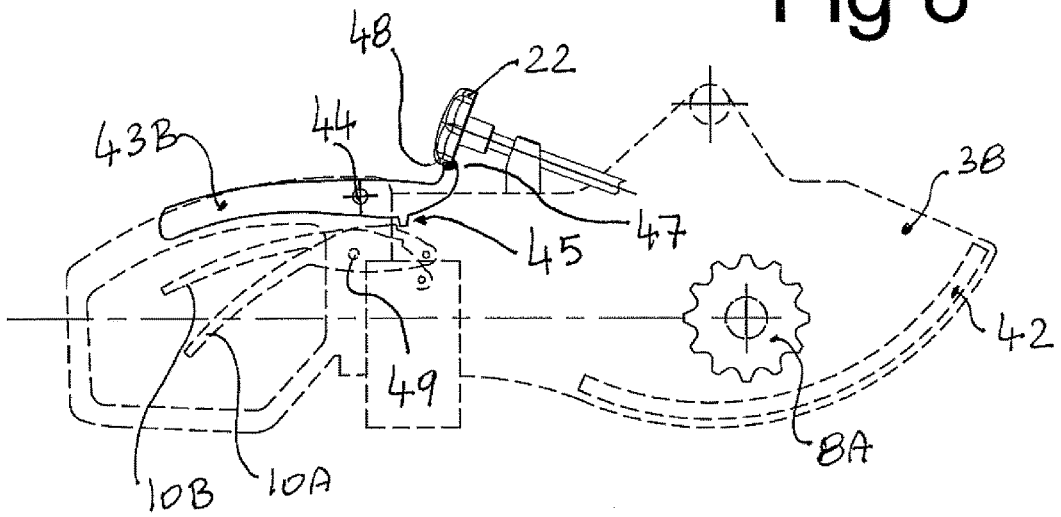

QUICK CHAIN TENSIONING SYSTEM

CROSS-REFERENCE TO RELATED PATENT APPLICATION

This patent application claims the benefit of U.S. Provisional Patent Application No. 62/497,518, filed Nov. 22, 2016, the entire teachings and disclosure of which are incorporated herein by reference thereto.

FIELD OF THE INVENTION

The present invention relates to the field of hand held equipment for construction, more particularly to a quick chain tensioning system applicable to portable chainsaws.

BACKGROUND OF THE INVENTION

The development of cutting tools for the construction field has always been very active in providing solutions for efficiently and safely cutting reinforced concrete, with a particular focus on providing tools for manually held equipment and to allow the operator to carry out the jobs safely and with minimum fatigue.

Among these tools there is a product called portable diamond chainsaw, which has been developed mostly to perform deep cutting as well as precise square corners cutting with no overcuts. Chainsaws for concrete cutting are in "somewhat" similar to chainsaw for "forestry" wood cutting, the main difference is that the guiding bar features a built-in water feed system and the chain cutters are diamond tipped, usually laser welded to an heavy duty chain chassis. Likewise wood-cutting, most of these tools are hand held and powered with a hydraulic motors or gasoline engines.

While both chain stretches as a result of the unavoidable wear of the chain chassis, the forestry chains are cutting wood and are oil lubricated while the concrete chains are cutting hard concrete, which is often very abrasive and reinforce with steel bars and use water through the guiding bar as only cooling and lubricating means. They are employed with minimal water lubrication and require an average traction power easily double of the ones for forestry. As a result, the chain needs far more frequent re-tensioning cycles, often the cycle takes longer and many re-tensioning device solutions developed for forestry proved to be unsuitable for concrete chainsaws.

Many chainsaws for concrete cutting are powered by hydraulic motors and typically, each re-tensioning cycle requires the user to stop the chainsaw, stop the power-pack oil supply, close water supply to the chainsaw, clean the equipment, take the necessary tools, and operate the chain re-tensioning procedure before resuming operation.

Furthermore, not likewise chains for forestry, chains for concrete cutting are far heavier, subjected to larger centrifugal forces and dynamic loads, and operate in very harsh operating conditions. As a result, they have the tendency to stretch far more rapidly and keeping them properly tensioned within a narrow range during cutting becomes far more critical.

As a matter of fact, the diamond chains life is limited to approximately 8 hours and with frequent chain tension adjustments throughout its cutting life. Each chain tension adjustment requires, essentially, the operator to release the guiding bar and move it outwardly versus the stationary, motorized driving sprocket, thus re-establishing a desired chain tension. This bar displacement is usually provided by means of a suitable chain adjusting device, typically a manually operated screw system.

Once the chain tension tensioning is brought back to normal, it is necessary to firmly re-clamp the bar in a newly established position before resuming operation. It is important to observe that for diamond chains, the correct chain tension does not correspond to a position where the chain is completely tensioned (zero sag) otherwise an intolerable friction would considerably shorten their life. Consequently, during the chain re-tensioning procedure, the operator brings out the guiding bar as much as possible but has then has to retract it back approximately ⅛" in order to find what it is defined to be the optimal "starting" condition. This, somewhat, aggravates the operator's effort overall. This requirement for retracting the bar back slightly before final re-clamping of the bar makes more difficult any attempt to automate such movement.

The most common system adopted in conventional chain saws to clamp the bar is typically provided by means of two bolts firmly clamping the guidebar sideways against the chainsaw body, while the most common position adjustment means is a screw engaged with the guiding bar which make possible a linear travel of the bar versus the chainsaw body. As a result of these two different means for adjustment, the operator requires a wrench and a screwdriver as basic tools to operate the chain re-tensioning procedure.

This is a well know drawback of the diamond chain sawing system. Due to chassis excessive stretching (elongation), chain re-tensioning becomes inconvenient to the operator due to the frequency of stops and continuous visual monitoring of the tool status in order to run the equipment within a relatively narrow operating range.

Additionally, since the chain tensioning procedure is frequent and inconvenient, operators have the tendency to operate the equipment as much as they can and this becomes a safety hazard for the operator, as a "loose" chain can break and/or create many undesired side effects.

More specifically, usually the bar clamping is provided by two screws which clamp the bar between the cover and the body of the chainsaw. More advanced system use one single bolt eventually locked in position by means of a quick-set lever.

The linear movement of the chain guide-bar away from the chainsaw body and driving sprocket stationary connected thereto, is provided by a screw located inside the chainsaw body operable by means of a screwdriver. More advanced systems, are eventually opting for a cam mechanism or a spiral screw, conveniently integrated inside the chainsaw cover, thus more accessible and quick to be operated.

These known solutions are all fundamentally based on the chainsaw presenting one single body offering no relative movement between the bar clamping system and the motorized chain driving sprocket and they all make possible the take-up of the chain slack by releasing the guiding bar and moving it forward relative to the sprocket.

More precisely, the bar clamping surfaces and bar clamping device allows the bar to slide linearly, relatively to a stationary driving sprocket between two limits, the bar adjust range being typically larger than the predicted overall chain stretch occurring during its operating life, defined by the two limit conditions of new and completely worn out chain.

Basically, portable chainsaws feature a single body, comprising motorized sprocket, bar clamping surface and a cover. The chain tensioning device requires that the bar be unclamped to create a linear movement of the bar moving away from a stationary sprocket in order to compensate for the chain stretch, thus re-establishing a desired chain tension.

The chain operating range for a diamond chainsaw it is typically comprised between one and two inches, thus considerably wider than wood cutting applications. Nevertheless, sometime the chain stretches even longer than the equipment chain tensioning operating range, and the operator has to ultimately remove one or more links from the chain in order to exhaust the chain diamond tips.

FIGS. 1A and 1B show a conventional chainsaw tensioning system for concrete cutting including a chainsaw body 1, a chain guidebar body 12, a guidebar mounting surface 2, bar clamping bolts 3, a tensioning screw 4, a tensioning pin 5, and a water supply slot 6. It also comprises a chain 16, a motorized driving sprocket 8, the primary operator handle 9, the switch level 10, the safety interlock 11, and a secondary operator handle 7. The chain guiding bar 12 features a central slot 13, tension holes 14 and a water inlet 15.

FIG. 1B schematically shows how the operator connects the guiding bar 12 to the chainsaw body 1. In particular, driving sprocket 8 is mounted stationary versus the chainsaw body 1 and is driven by a motor mounted on the back (not visible).

The bar is clamped to the mounting surface 2 by means of clamping bolt 3 in an initial position 14 which is the closest to the driving sprocket 8 and represents the starting point of when chain 16 is new and at its original length. During operation, as a result of chain stretching, the operator is required to perform multiple chain retention cycles. As previously explained, this requires the user to temporarily release bar 12 from the body 1 and, and by means of turning the tension screw 4, relocate the bar in a new position, facing outwardly until chain 16 returns back to normal tension status. After that, bar 12 is firmly re-clamped to the new position by tightening clamping bolts 3. As explained, this is necessary to do a multiple number of times in order to operate correctly and within the desired tensioning range. It is important to observe that diamond chains cannot start operation when the chain is in full tension. As a result, it is necessary to move the bar to a full chain tensioning status and then to retract slightly, making the re-tensioning cycle more complicated.

It is also important to observe, that the bar can be adjusted from two extreme positions indicated in 14 and 15, representing respectively the minimum and maximum bar location within a limited adjust stroke T1, typically around two inches. If the chain stretch exceeds the adjust stroke T1, the operator has no other choice than to shorten the chain (for example, removing a couple of links) in order to exhaust the chain life.

The need for a quick and safe chain re-tensioning system is therefore well known and several attempts have been made to improve it. All known devices are based, though, on easing or partially automating the conventional chain re-tensioning process, which requires unclamping of the guiding bar, moving the guiding bar away from a stationary sprocket by means of a linear motion, and clamping the bar back at a desired new location versus the chain driving sprocket.

Embodiments of the present invention provide a quick chain tensioning system and method, which significantly reduce the operator efforts and time in re-establishing proper chain tension during cutting.

BRIEF SUMMARY OF THE INVENTION

Unlike conventional chainsaws, and as better described hereinbelow, embodiments of the chain quick tensioning system and method for concrete hand saw according to the present invention includes two distinct bodies. These bodies include a motor slide body having an operator handle, motor, transmission and driving sprocket connected thereto and a separate bar holder body having a guiding bar clamping device and a safety cover.

Interposed between these two bodies is an innovative system that has guiding means and related driving means. Such an embodiment is designed to allow a well guided relative motion between the two separate bodies, thus allowing a corresponding relative motion capable of changing the position between driving sprocket mounted to the motor slide body and the chain guiding bar mounted to the bar holder body seen stationary.

According to one embodiment of the present invention, the guiding means is a linear "V" guide, inspired to a "dove-tail" guide system, providing a smooth and robust guiding of the linear motion between the two chainsaw bodies, while the driving means is a screw and nut that converts the rotation of a knob into a rotation of the driving screw, and ultimately urging a linear displacement of one body versus the other.

According to an alternative embodiment of the present invention, the guiding means is a rotation of one body versus the other around a common hinge, which allows the driving sprocket to move versus the guiding bar according to a desired "pendulum" motion, still ultimately, providing the desired relative motion between chain driving sprocket and chain guiding bar.

In one embodiment, the driving means is a cantilever or a cam mechanism to impress a desired linear or angular rotation of one body versus the other and consequently make possible adjustment of the relative position between the bodies within a given operation range.

In a preferred embodiment, the system and method utilizes two different bodies, each holding firmly respectively the motorized sprocket and the chain guiding bar. In such an embodiment the chain re-tensioning happens as modification of the relative position of one body versus the other. In particular, the driving sprocket retracts with the entire first body while the guiding bar remaining stationary and with the second body.

According to an additional embodiment of the present invention, the second body incorporates a secondary chain tensioning system, in addition to the above mentioned primary one, offering the ability to secure the chain guiding bar position in different locations versus the second chainsaw bar holder body. This allows the ability to extend the operating range of the primary tensioning system. In particular, an operator can quickly and safely operate the primary tensioning system by re-setting a new relative position of one body until the adjusting device reaches its stroke limit, and then can conveniently re-set the primary device by operating on the secondary adjust system by means of a one-step guiding bar shift and conveniently return to use the quick, primary system.

The secondary chain adjust system and method of such embodiment is intentionally designed so that users of the existing, conventional manual chain tensioning adjusting system, that nearly all guiding bars available in the marketplace are presently offering and that have all of the necessary features for manual adjust of the guiding bar versus the chainsaw body, will easily feel familiar with such procedure.

According to another embodiment of the present invention, the guiding system includes locking means that are capable of freezing the relative position between the two bodies and consequently increase the safety of the cutting operations. Such means need to be unlocked each time the operator would decide to adjust the chain tension. The locking means can be conveniently incorporated with the main safety lever existing in the equipment, thus interlocking the use of the quick tensioning knob while the chainsaw motor is running.

Embodiments of the quick chain re-tensioning system and method of the present invention are applicable to any chainsaw, although in preferred embodiments they are particularly applicable to hand held chainsaws for concrete cutting. Embodiments of the present invention also include a kit that may be used to retrofit any existing concrete chain saw with the features and benefits of the present invention. Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 8 shows a safety device of an embodiment of the system of the present invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 2A:
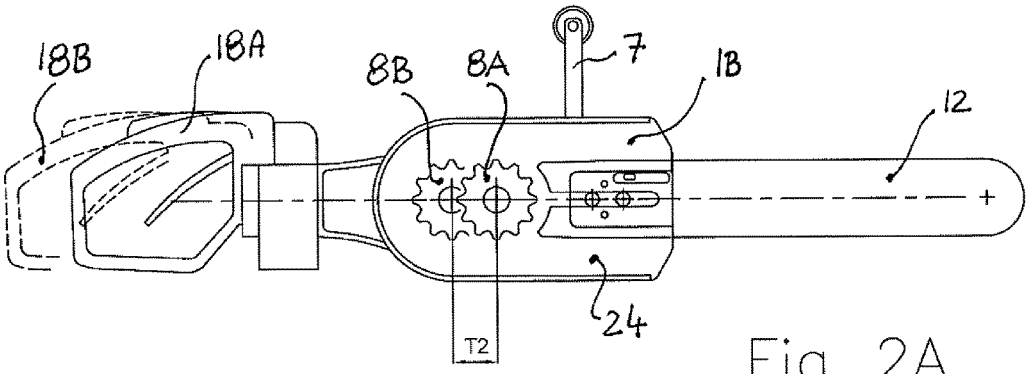
FIGS. 2A and 2B schematically show a concrete diamond chain re-tensioning procedure using the chain tensioning system according to an embodiment of the present invention.
Figure 2B:
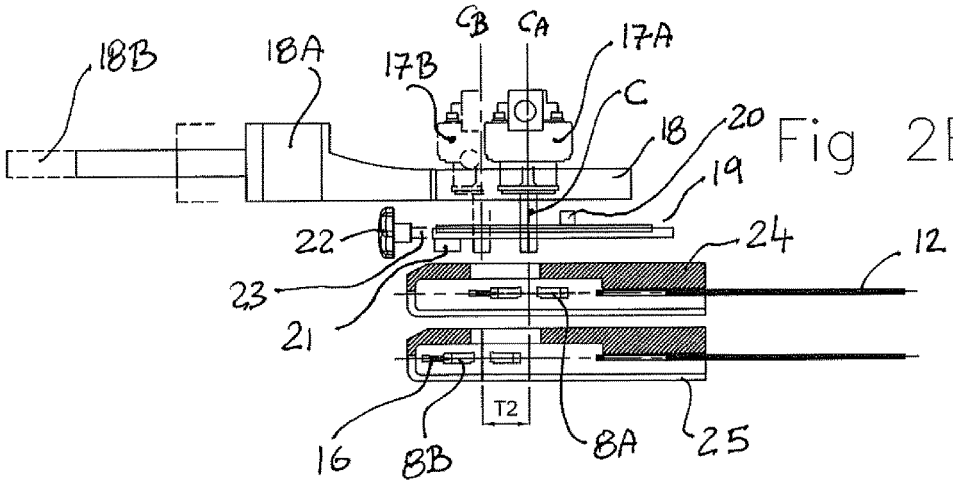

Turning now to the drawings, and particularly to FIGS. 2A and 2B, there is illustrated an embodiment of a chainsaw for concrete cutting that includes a chin re-tensioning system according to one embodiment of the present invention. It should be noted, however, that while the following description will discuss various embodiments of the present invention in a particular operating environment, to wit a tensioning system for a concrete diamond chain, applications of the teachings of the present invention may find use in other environments, and the exclusive right thereto is reserved in accordance with the claims appended hereto. In other words, the following exemplary embodiments should be taken by way of example and not by way of limitation.

FIG. 2A schematically represents the innovative quick tension system according to an embodiment of the present invention. As illustrated, guide-bar 12 remains firmly clamped to the chainsaw body 1B and stationary while the driving sprocket 8 is retracted a stroke T2 between limit position 8A and 8B. This allows re-tensioning of the chain as needed.

FIG. 2B illustrates the chainsaw body split in two separate bodies, to wit, a motor slide body 18 and a bar holder body 24. Interposed between the motor slide body 18 and a bar holder body 24 is a linear guide system 19, equipped with a manual operated adjusting screw 23, which makes possible a linear motion of motor slide body 18 versus a bar holder body 24 considered stationary.

As FIG. 2B shows, motor slide body 18 carries motor 17 and its shaft C, and as a result of this motion, is capable of shuttling between a limit position indicated with center line CA and CB. The driving sprocket 8, which is mounted onto shaft motor C, can consequently retract a maximum stroke T2 between sprocket location 8A and 8B. FIG. 2B also shows that guiding bar 12 is permanently clamped to bar holder body 24, a cover 25, a screw and blocks 20 and 21, respectively connected motor slide body 18 and bar holder body 24. This arrangement makes possibly the motion of motor slide body 18 versus bar holder body 24 by turning knob 22, which drives the adjusting screw 23, thus allowing the operator to set a location of driving sprocket 8 in any desired position within the range T2.

Figure 3:
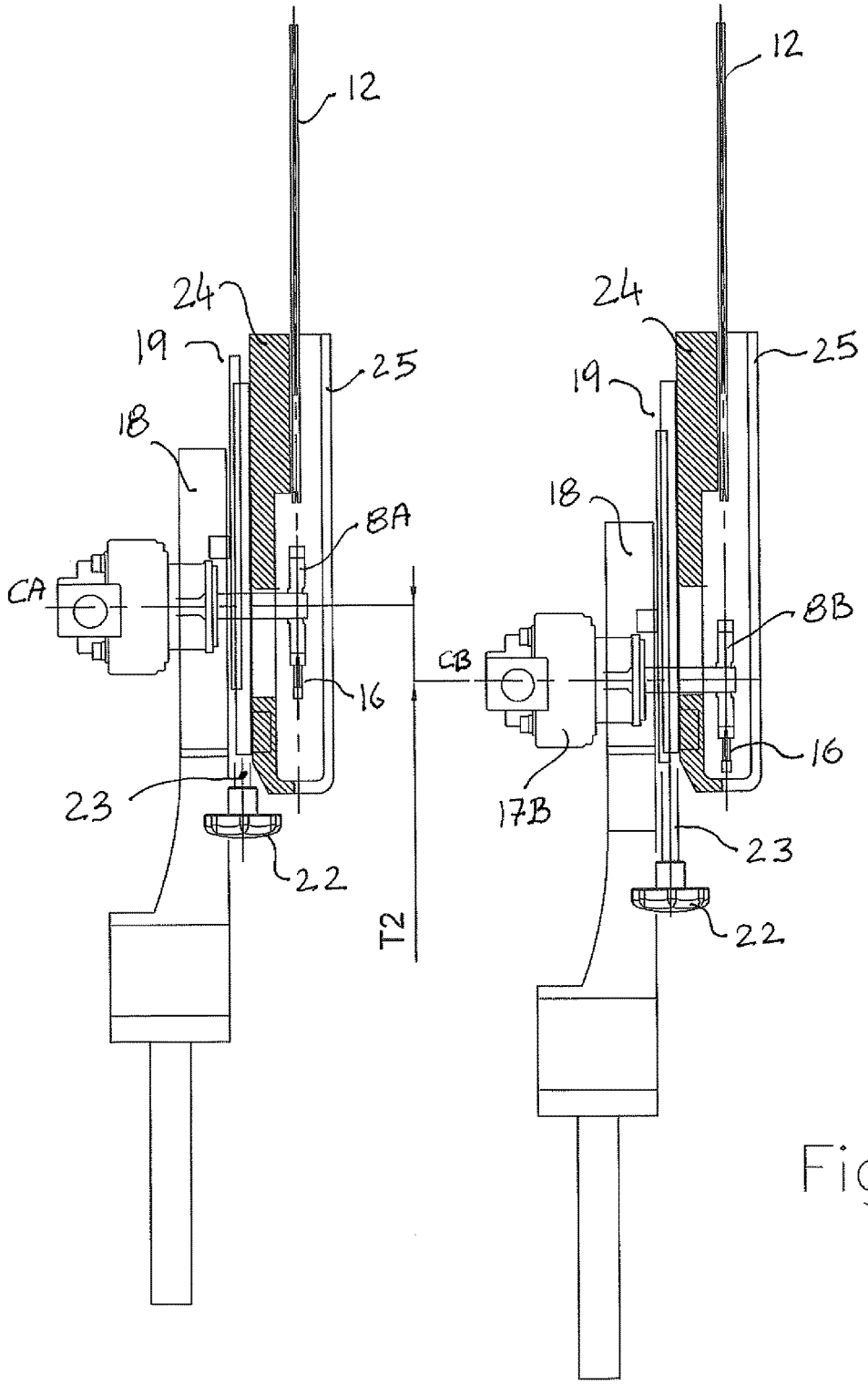
FIG. 3 shows more in detail the tensioning system of FIG. 2B.

FIG. 3, by means of cross sections, schematically shows in better detail the system described in FIGS. 2A and 2B by illustrating, respectively, the two extreme positions corresponding as mentioned to the initial condition of chain new versus chain completely stretched. It should be noted that guided bar 12 is permanently mounted in a fixed position versus bar holder body 24 and the driving sprocket 8 can linearly retract, for a stroke T2, between the two limit positions indicated with 8A and 8B in FIG. 3. The motor slide body 18 is therefore capable to slide back, firmly guided by means of guide system 19.

Figure 4C:
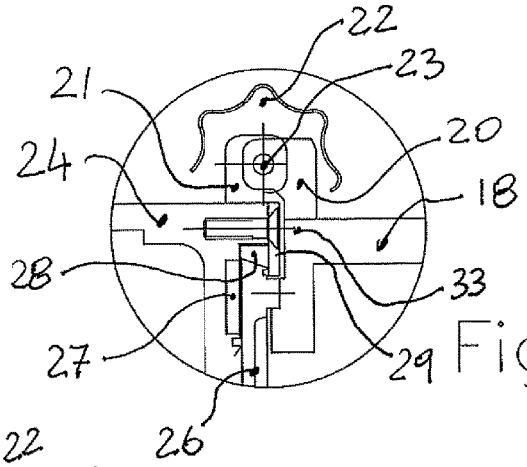
FIGS. 4A, 4B, and 4C schematically show the quick chain tensioning system according to an embodiment of the present invention.
Figure 4B:
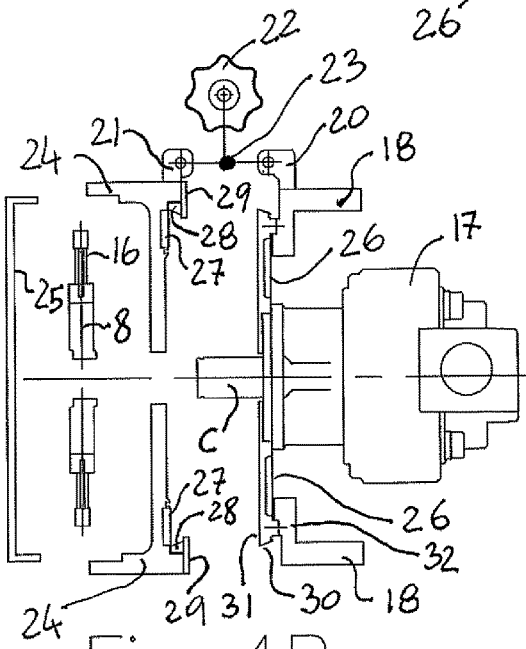
Figure 4A:
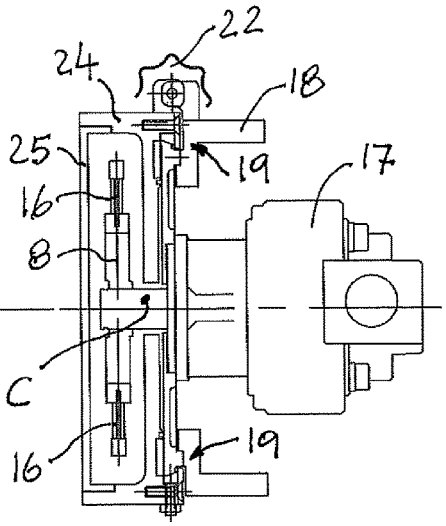

FIG. 4A illustrates a cross section of the quick tensioning system described in the embodiment of the present invention discussed above. This FIG. 4A illustrates the motor slide body 18, the chainsaw motor 17, its output shaft C, the driving sprocket 8 coupled thereto, the diamond chain 16, and guiding system 19 interposed to the chain body holder 24. FIG. 4B illustrates an exploded view of the quick tensioning system's main components, in particular, a guiding plate 26 firmly mounted to motor slide body 18, which represents the sliding portion of guiding system 19, and rectangular pad 27 and trapezoidal guide 28 with its own retaining flange 29 connected to body 24. Guide 27 and 28 are preferably low friction materials offering guide to the corresponding surfaces 30 and 31 of said slide 26. FIG. 4B also shows screw terminal blocks 20 and 21 respectively connected to body 18 and 24. Terminal blocks 21 and 20 define mounting for tensioning screw 23 carrying knob 22 at one of its ends.

FIG. 4C provides an enlargement of guiding system 19 interposed between motor slide 18 and bar holder 24, with all its main components, to wit, guides 27 and 28, flange 29, terminal block 20 and 21, screw 23 and its knob 22.

Figure 5A:
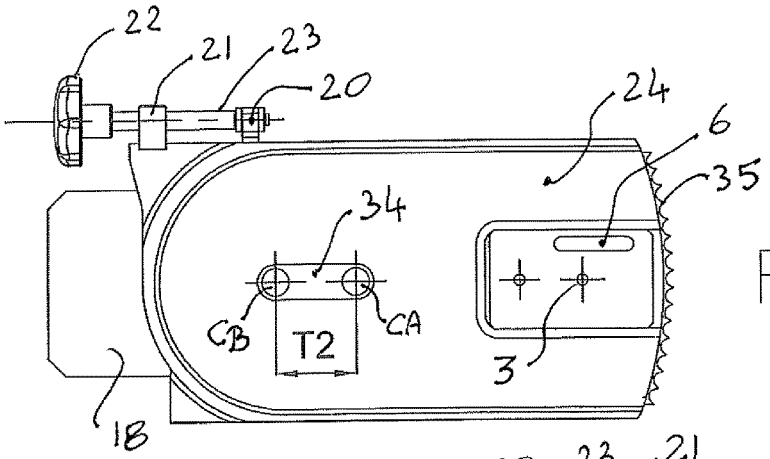
FIGS. 5A, 5B, and 5C are more detailed views of elements of the chain tensioning system illustrated in FIGS. 4A and 4B.
Figure 5B:
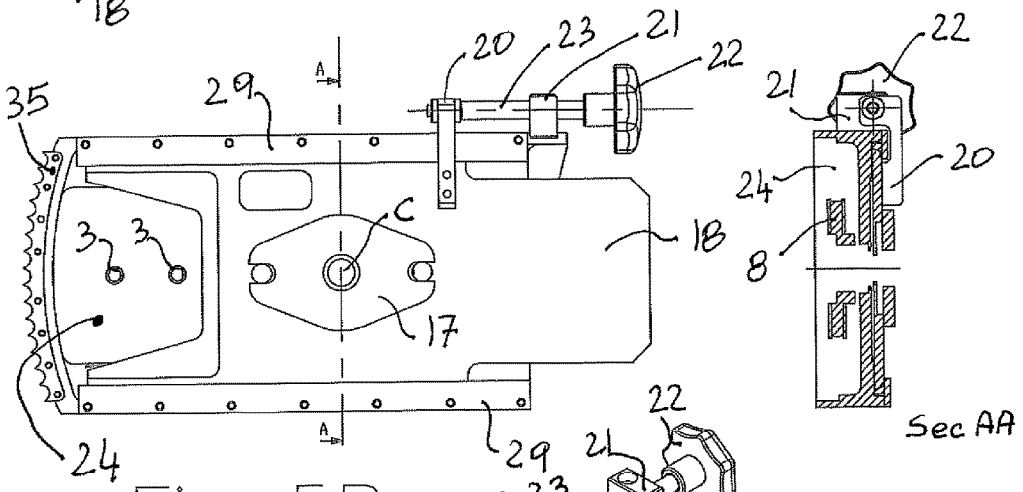
Figure 5C:
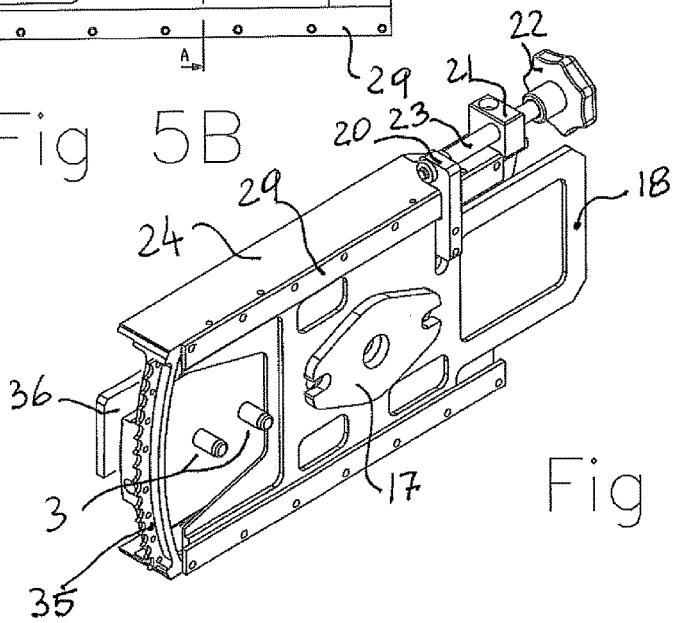

FIGS. 5A, 5B, and 5C, respectively, illustrate a front view, a rear view, a cross section and a prospective view of the quick tensioning system described above. In particularly, its noticeable how the motor shaft can assume any position between CA and CB rotating inside a slot 34 of body 24, the screw drives system, responsible to provide any desire motor slide position 18 versus stationary body 24 and an arcuate claw 35, firmly bolted to body 24, engineered to provide gripping of the chainsaw to the wall for operator fatigue aid during cutting. FIG. 5C shows arcuate claw 35 and bar clamping plate 36 offering active guiding bar clamping means and its clamping screws 3.

Figure 1A:
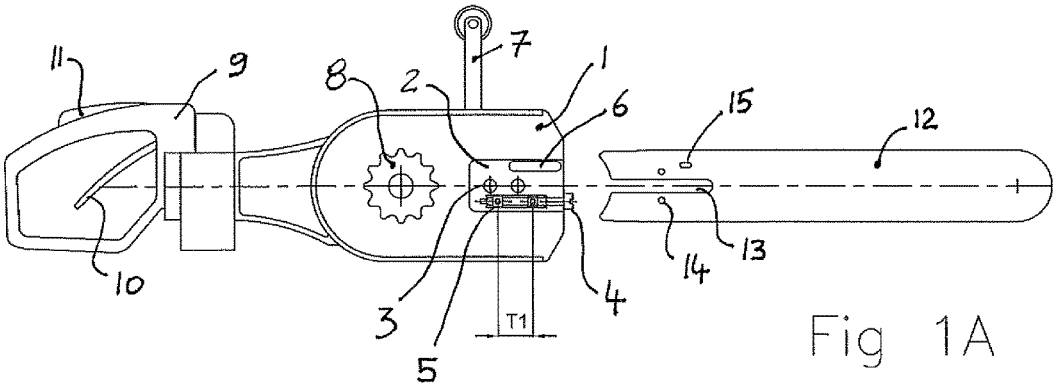
FIGS. 1A and 1B schematically show a concrete diamond chain re-tensioning procedure using a conventional chain tensioning system.
Figure 1B:
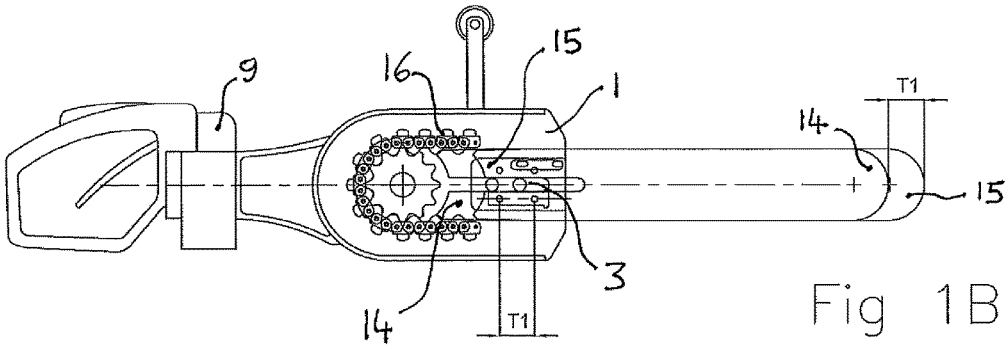
Figure 6:
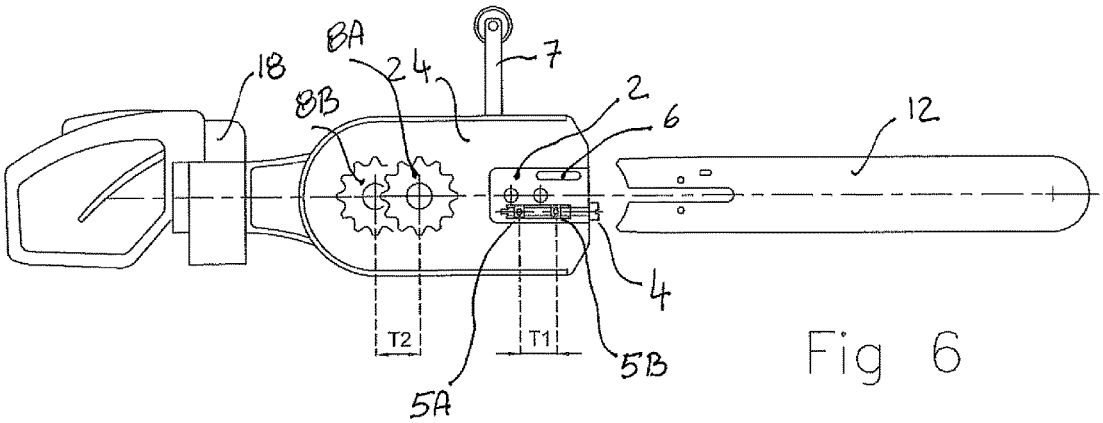
FIG. 6 shows an additional feature of an embodiment of the system of the present invention.

FIG. 6 shows an alternative embodiment of the system above described including a first, primary quick tensioning system based on retracting the driving sprocket 8 for a stroke T2, and a second, secondary quick tensioning system. In this embodiment, the user can move bar 12 versus bar holder 24 for a stroke T1, thus allowing the operator to adjust chain tensioning for a combined range positioning of T1 plus T2. This secondary system is similar to the conventional system described above with regard to FIG. 1, but provides the additional advantage to re-arm the primary system and extend the operating range up to twice the T2 adjustment stroke (when T1 equals T2).

Figure 7:
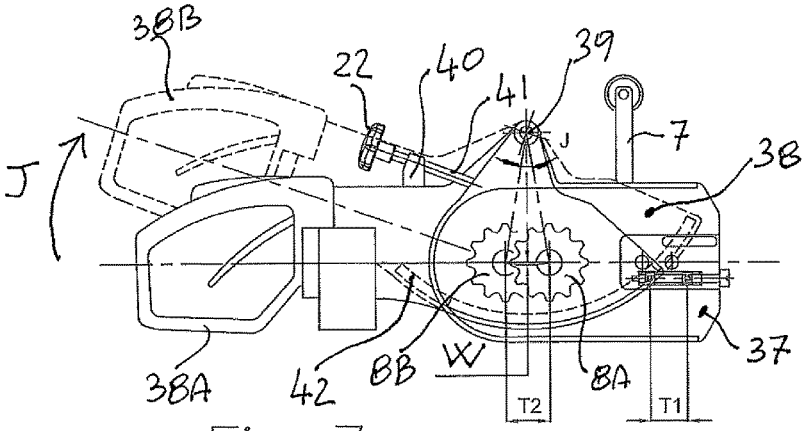
FIG. 7 schematically shows the quick chain tensioning system according to an alternative embodiment of the present invention.

FIG. 7 shows an alternative embodiment of the quick tensioning system according the present invention wherein the T2 adjustment of driving sprocket within limit positions 8A and 8B is achieved by a pendulum-like rotation of motor slide 38 versus stationary bar holder 37 pivoting around hinge 39 of an assigned angle J. It should be noted that the driving sprocket path within the limit positions 8A and 8B is an arch rather than a linear segment. As such, the center line of the sprocket deviates from the guide bar 12 centerline of a displacement W. However, in one embodiment, if T2 is lower than 1 and ½ inch, W displacement does not negatively impact the chain functioning.

According to another feature of the present invention, the guide system interposed between motor slide body and bar holder body has a locking device that locks the motion between the bodies and constrains the two bodies firmly together when the motor is spinning and, for safety reasons, prevents any chain adjust while the chain is moving.

Such feature can be provided in one embodiment by the device illustrated in FIG. 8. The device comprises a safety lever 43A which interacts with the switch lever 10A as well as with the knob 22. In particular, when lever 43A, which is spring loaded in the open position, is not pressed down, its primary tooth 46 inhibits rotation of lever 10A around hinge 49 while its second tooth 47 is disengaged from the body of knob 22. This allows the operator free and safe to operate the chain tensioning system. When the operator intends to power motor, he has to press down safety lever to position 43B. In this position 43B the switch lever is disengaged from 10A to 10B while tooth 47 engages cavity 48, present all around knob 22, to provide an active interlock to prevent operation of the tensioning system.

From the above description, it may be appreciated that the chain quick tensioning system according to embodiments of the present invention achieves one or more of the goals set forth and offers numerous advantages. For example, once the chain needs re-tensioning, the operator can, without any tool, suspend cutting and re-establish a any desired chain tensioning quickly, effortlessly and safely. This operation does not alter the chainsaw net cutting depth as the bar remains firmly anchored to its bar holder body. Indeed, the tensioning stroke is abundant and allows continued operation to exhaust the chain with no need whatsoever to shorten the chain by removing links. Further, the operator can conveniently take measure of how the chain stretching is progressing by visibly monitoring the relative stroke between the motor and bar holder bodies, thus adjusting water flow to reduce stretching.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A quick chain tensioning system for a portable chainsaw, comprising:

a motor slide body carrying a motor, an operator handle and a chain driving sprocket connected to an output shaft of the motor;

a bar holder body including a chain guiding bar;

a guide system, positioned between the motor slide body and the bar holder body, providing a guided relative motion of the motor slide body versus the bar holder body;

driving means, interposed between the motor slide body and the bar holder body, configured to bring the motor slide body to any desired relative position in relation to the bar holder body, within a given stoke limit dictated by the guide system to adjust chain tension by retracting the chain driving sprocket versus the chain guiding bar to compensate for chain elongation without releasing the chain guiding bar from the bar holder body and without modifying a net cut depth of the chainsaw.

2. The quick chain tensioning system of claim 1, wherein the guide system is a heavy duty dove-tail guiding system, configured to transmit cutting reaction forces to a handle of the chainsaw and to provide smooth linear motion between the motor slide body and the bar holder body along a centerline of the chain guiding bar.

3. The quick chain tensioning system of claim 1, wherein said driving means includes a screw connected to a knob and anchored to the motor slide body, engaged in a nut anchored to the bar holder body to allow the operator to control a relative linear position between the motor slide body and the bar holder body by turning the knob.

4. The quick chain tensioning system of claim 1, wherein the bar holder body includes a built-in secondary chain tensioning system configured to allow manual modification of a mounting position of the chain guiding bar versus the bar holder body.

5. A chain tensioning system for a chainsaw having a guide-bar clamped to a bar holder body and a motor slide body carrying a motor, an operator handle and a chain driving sprocket connected to an output shaft of the motor, the chain being guided by the guide-bar and driven by the sprocket, comprising:

a guide system interposed between the bar holder body and the motor slide body, the guide system including an opening through which the output shaft of the motor protrudes such that the driving sprocket is positioned on a same side of the guide system as the bar holder body, and wherein the guide system includes a guiding plate firmly mounted to the motor slide body, the guiding plate having a first screw terminal block affixed thereto, and a rectangular pad and trapezoidal guide having a retaining flange connected to the bar holder body and a second screw terminal block affixed thereto, and a manual operated adjusting screw having a user knob threadably received in the first screw terminal and the second screw terminal such that rotation of the adjusting screw moves the output shaft of the motor in the opening to reposition the sprocket relative thereto to adjust tension on the chain.

6. The chain tensioning system of claim 5, wherein the rectangular pad and trapezoidal guide are formed of low friction materials offering guide to the guiding plate.

7. The chain tensioning system of claim 5, wherein the slot is linear such that rotation of the adjusting screw changes a distance from the sprocket to the distal end of the guide-bar.

8. The chain tensioning system of claim 5, further comprising a safety lever operably coupled between the operator handle and the adjusting screw such that actuation of the safety lever by an operator grasping the handle of the chainsaw positions a first tooth of the safety lever in contact with a cavity of the knob of the adjusting screw to prohibit rotation thereof.

9. The chain tensioning system of claim 8, wherein the safety lever includes a second tooth that prohibits actuation of a switch lever when the safety lever is in a quiescent position thereby prohibiting operation of the chainsaw.

10. The chain tensioning system of claim 9, wherein the first tooth is disengaged from the cavity of the knob of the adjusting screw to allow rotation thereof when the safety lever is in the quiescent position.

11. The chain tensioning system of claim 5, further comprising a secondary chain tensioning system configured to allow manual modification of a mounting position of the guide-bar versus the bar holder body.

* * * * *